United States Patent [19]

Gregorian et al.

[11] 4,299,591

[45] Nov. 10, 1981

[54] TEXTILE PRINTING PROCESS

[75] Inventors: Razmic S. Gregorian, Aiken; Chettoor G. Namboodri, North Augusta, both of S.C.

[73] Assignee: United Merchants and Manufacturers, Inc., New York, N.Y.

[21] Appl. No.: 943,831

[22] Filed: Sep. 19, 1978

[51] Int. Cl.[3] ..... D06P 5/02; D06P 3/52; D06P 3/24

[52] U.S. Cl. ..... 8/477; 8/505; 8/495; 8/149.1; 8/929

[58] Field of Search ..... 8/1 XB, 14, 73, 477, 8/495, 505, 149.1, 929

[56] References Cited

U.S. PATENT DOCUMENTS

| | | | |
|---|---|---|---|
| 2,971,458 | 2/1961 | Kumins et al. | 8/62 |
| 3,030,232 | 4/1962 | Morgenstern | 428/224 |
| 3,042,573 | 7/1962 | Roberts | 427/296 |
| 3,762,860 | 10/1973 | Abrahams et al. | 8/1 XB |
| 3,932,129 | 1/1975 | Porter | 8/444 |
| 3,934,971 | 1/1976 | Blanchard et al. | 8/14 |
| 3,945,791 | 3/1976 | Bohrn | 8/14 |
| 3,954,404 | 5/1976 | Childers et al. | 8/1 XB |
| 3,969,780 | 7/1976 | Henderson | 8/149.1 |
| 3,990,840 | 11/1976 | von der Eltz et al. | 8/18 R |
| 4,058,644 | 11/1977 | DeVries et al. | 8/471 |
| 4,099,913 | 7/1978 | Walter et al. | 8/169 |
| 4,118,526 | 10/1978 | Gregorian et al. | 8/4 |
| 4,146,362 | 3/1979 | Nichols | 8/14 |

FOREIGN PATENT DOCUMENTS

| | | | |
|---|---|---|---|
| 853697 | 8/1977 | Belgium . | |
| 2304104 | 1/1974 | Fed. Rep. of Germany | 8/929 |
| 1134221 | 11/1968 | United Kingdom . | |
| 1157737 | 7/1969 | United Kingdom | 8/1 XB |
| 1496892 | 1/1978 | United Kingdom . | |

OTHER PUBLICATIONS

Fox et al. Jour. Soc. of Dyers & Colorists—Dec. 1973 pp. 474–483.

*Primary Examiner*—Maria Parrish Tungol
*Attorney, Agent, or Firm*—Michael A. Caputo

[57] ABSTRACT

Disclosed herein is a process for printing on textile materials, particularly pile type fabrics, wherein a foamed printing composition is first applied to the textile material; a second foamed composition is thereafter uniformly applied onto the textile over the printing composition prior to fixation of the latter; the second applied foam is then collapsed to form a pre-selected print on the textile; and the printed textile is then subjected to color fixation.

10 Claims, 1 Drawing Figure

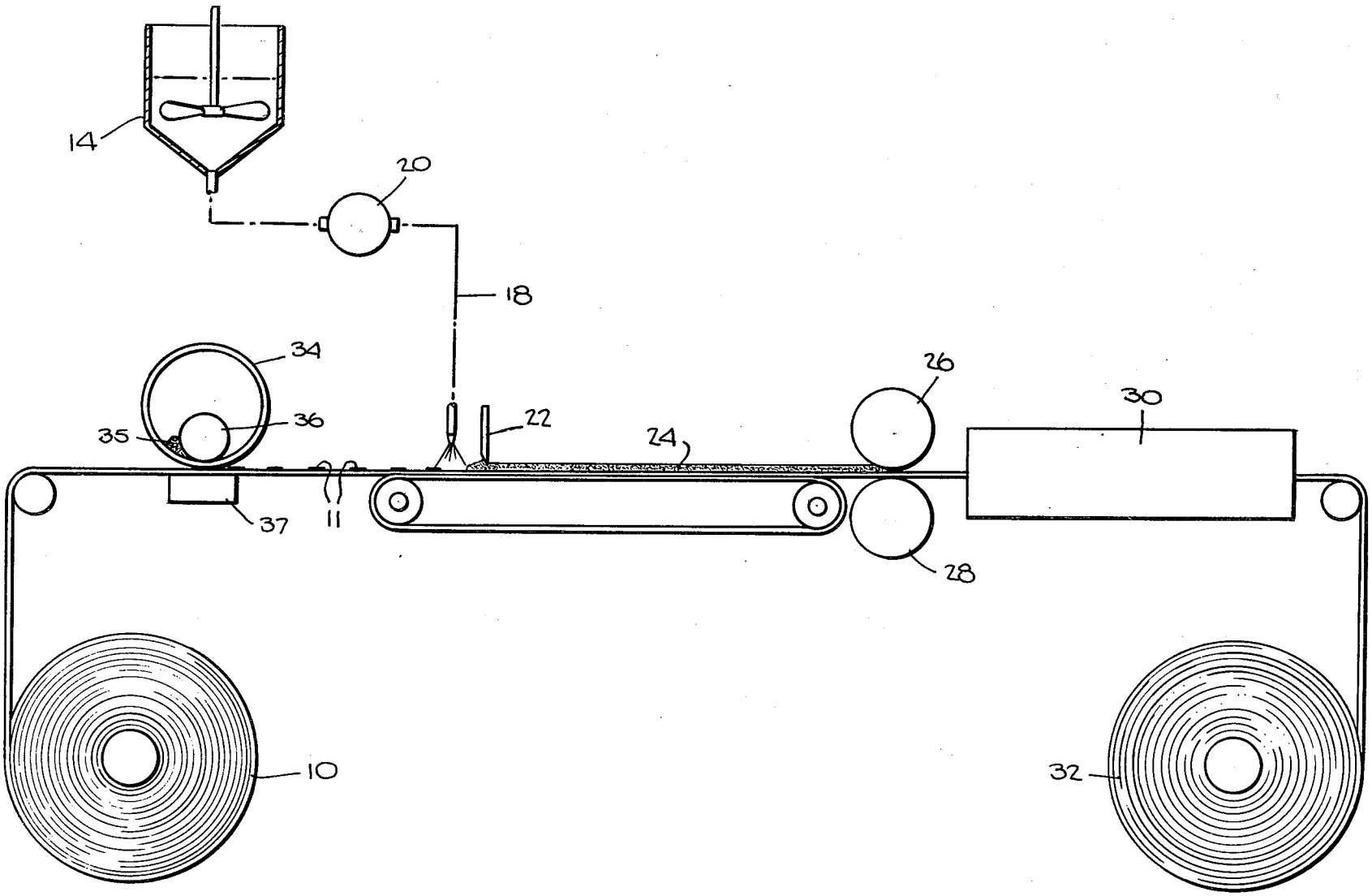
14
20
18
22
24
26
28
30
32
34
35
36
37
10
11

TEXTILE PRINTING PROCESS

BACKGROUND OF THE INVENTION

This invention relates to the printing of textile materials and, more particularly, to the printing of such materials utilizing foamed printing compositions.

In recent years the art of printing pre-selected patterns on textile materials has become increasingly developed and widespread. Typically, such processes utilize a printing composition which is applied to the engravings of a printing cylinder, which cylinder is then brought into contact with the textile to transfer the print composition thereto from the engravings. Alternatively, a printing composition may be admitted to a rotary screen printer wherein a print composition is forced through the stencil-like apertures of a surrounding printing cylinder in contact with the textile material.

The most recent advances in this environment center on the formulation of the print composition, particularly in the utilization of foamed printing composition. Thus, for example, U.S. Pat. No. 2,971,458 to Kumins, et al. describes a process for printing textile materials wherein a printing paste thickened by incorporation of air therein is used. More recently, our commonly-assigned co-pending U.S. patent application Ser. No. 584,389, filed June 6, 1975 now U.S. Pat. No. 4,118,526 describes processes and compositions for applying finishing agents, including colorants, to fabrics wherein the agent, liquid and a foaming agent or stabilizer are whipped into a stable foam having a specified range of density and blow ratio. The foam is applied to the fabric and then collapsed to achieve penetration of the finishing agent into the fabric.

The utilization of such foamed compositions has the advantage of significantly reducing the amount of liquid medium needed in the print composition as compared to conventional processes and thereby, among other advantages, reduces costly liquid removal processes and processing difficulties associated with the large liquid absorption capacity of many textiles.

In the printing of patterns on textiles utilizing foamed printing compositions, the foam is, of course, applied to only selected portions of the textile corresponding to the pre-selected engravings or stencils of the printing apparatus. It has been found that difficulties may be encountered in penetrating the fabric with the printing composition, particularly in the uniformity and extent of penetration of the print into the textile. Thus, for example, where foam collapse and penetration is to be achieved by application of a vacuum to the underside of the textile, it is found that the vacuum will pull or act primarily in those areas offering the least resistance, i.e., in the areas where foam has not been applied, resulting in non-uniform penetration of the print into the textile. Such may present a particular problem when printing on high pile fabrics.

SUMMARY OF THE INVENTION

It is accordingly an object of this invention to provide an improved process for printing pre-selected patterns on textile materials.

A further object of this invention is to provide such a printing process for high pile type fabrics wherein deeply-penetrated, uniform prints are obtained.

In accordance with the present invention, these objects are achieved by the provision of a process for printing on textiles wherein a color-containing printing composition is first applied to a textile material in a pre-selected pattern. Thereafter, the textile material is uniformly coated with a foamed composition which is collapsed to result in penetration of the print composition into the textile in accordance with the preselected pattern. The printed textile material is then treated to achieve color fixation and liquid removal.

According to the present invention, a printing composition including a colorant therein is applied or printed onto the textile in a pre-selected pattern in a manner known in the art, e.g., by means of a rotary screen printer, an intaglio printing cylinder or spray nozzles. The so-treated textile material is then substantially uniformly coated with a foamed composition, hereinafter alternatively referred to as a "blanket" foam. This latter step may be accomplished in any known manner, e.g., by knife coating or reverse roll coating. In the context of the present invention, substantially uniformly coating the textile with the blanket foam composition is intended to describe and embrace the application of a color or non-color-containing foamed composition to the textile is such a manner that substantially all areas thereof, including those already covered by the printing composition, will be layered so as to present a substantially equal blanket of resistance to a subsequently applied collapsing means.

The textile material containing both the printing composition and the blanket foam composition is then treated to collapse the remaining foam and achieve deep penetration of the printing composition into the textile. Such foam collapse may be achieved by application of a vacuum to the underside of the fabric, and can also be accomplished by padding or compression or by a combination of vacuum and padding.

The textile material is then dried or further treated in accordance with conventional procedures to fix the print on the textile and remove excess liquid therefrom. By following this procedure, deep color penetration is achieved even with high pile fabrics printed by means of the foam method. With the blanket foam applied prior to fixation, the color penetrates down to the roots of the pile during collapsing of the blanket foam prior to the fixation of the color by steaming or heating.

The printing composition may also be in the form of a foam. In such a case, the foamed printing composition and the foamed blank composition are prepared from foamable mixtures which can be foamed to a blow ratio in the range of from about 2:1 to about 20:1 and a foam density in the range of from about 0.5 gm/cc to about 0.05 gm/cc. Suitable foamable compositions and means for converting these to stable foams for utilization in the present invention are described in our commonly-assigned application Ser. No. 584,389, now U.S. Pat. No. 4,118,526, which is incorporated herein by reference, and typically consist of a liquid medium and a foaming agent (foam stabilizer) together with a suitable colorant material. Other additional optional components of such foamable mixtures are described in our above-identified patent.

As utilized herein, a "color-containing foamed composition" is intended to describe a foamed composition containing dyes and/or pigments suitable for printing onto textiles, as well as pre-cursors of such colorants which are reactive with either a component of the textile or a component of the after-applied foam.

The blanket foamed composition according to the present invention may contain one or more finishing agents which impart particular properties to the textile. Examples of such finishing agents may be found in our above-identified patent and include water repellents, antistatic agents, soil release agents, fire retardant agents, softeners and the like. Thus, a textile material may be simultaneously printed and, e.g., rendered water repellent in accordance with this invention.

As utilized in this invention, textile material is intended to include, without limitation, fabrics from threads, yarns, woven or knitted goods, resin bonded mats of fibers, and the like.

BRIEF DESCRIPTION OF THE DRAWING

The drawing is a schematic diagram of a process in accordance with the present invention.

DESCRIPTION OF THE PREFERRED EMBODIMENT

Specific embodiments of the printing process of the present invention are described in more detail with reference to the drawing and Examples which follow.

Referring to the drawing, a roll of textile fabric 10, travelling in the direction indicated by the arrow, is conveyed to a printing station, shown herein as a rotary screen printer 34, wherein a printing composition is placed onto the textile in a pre-selected pattern 11. In those instances where the printing composition is in the form of a foam, at the printing station, the foam 35 is collapsed into the fabric by the roll 36 positioned above the magnetic bar 37. The so-treated textile is then moved to conveyor 12 which may be any type of conveying means conventionally used in the art, e.g., an endless conveying belt, a tenter frame, etc.

Simultaneously, in foamer 14 a blanket foamed composition is prepared. Foamer 14 may be any type foaming device conventionally used in the art, e.g., Oakes, Kitchenaid, Godwin Card, etc.

The foamed blanket composition is transferred through line 18 by pump 20 to knife 22 where it is substantially uniformly coated onto the textile having thereon the previously applied print composition. The so-coated textile fabric then passes through nip rolls 26 and 28 which serves to compress the foamed composition and insure that the printing composition, as well as any finishing agent contained in the blanket foam, penetrate throughout the fabric. Alternatively or additionally, a vacuum may be applied to the bottom side of the fabric to draw the foam into the fabric. Also, a combination of a vacuum and padding or any other suitable means to collapse the foam and achieve penetration may be employed. This penetration step also collapses and destroys the bubbles of the foam. Thereafter the printed fabric is conveyed through a color fixation means 30 and wound onto take-up roll 32.

The following examples are illustrative of the process of the present invention.

EXAMPLE I

A foamable printing composition was prepared containing 2 parts Telon Fast Green 5G (Acid Green 41) and 98 parts of a composition containing 3.5% Acrysol ASE-60 (an acrylic polymer emulsion having 28 percent solids from Rohm & Haas), 92.5% water, 0.5% ammonia and 3.5% ammonium stearate (33% soln.). The composition was foamed in a Kitchenaid (Hobart Corp.) mixer to a 3:1 blow ratio and printed in a preselected pattern onto a nylon carpet pile using a 50 mesh screen on a rotary screen printing machine.

A blanket composition containing 3.5% Acrysol ASE-60, 92.5% water, 0.5% ammonia and 3.5% ammonium stearate (33% soln.) was foamed to a 5:1 blow ratio and uniformly coated to a thickness of 50 mils onto the carpet pile containing the printing composition. The nylon carpet was then padded and wet steamed for 8 minutes at 210° F. under atmospheric pressure and the fabric was dried.

The acid dye printed in this manner gave good color penetration inside the pile of the nylon carpet and printing of good definition was obtained.

EXAMPLE 2

A printing composition was prepared containing 6 parts Telon Fast Green 5G and 94 parts of a composition containing 92.5% water, 3.5% Acrysol ASE-60, 0.5% ammonia and 3.5% ammonium stearate (33% soln.), foamed to a blow ratio of 3:1 and printed on a nylon carpet pile using a 50 mesh rotary screen printer.

A non-color-containing composition was prepared from a mixture of 4 parts Nopcostat LS 101 (an antistat from Nopco Chemical Co.) and 96 parts of a composition containing 92.5% water, 3.5% ASE-60, 0.5% ammonia and 3.5% ammonium stearate (33% soln.) and foamed to a 6:1 blow ratio. This foam was knife coated onto the carpet pile already containing the printing composition and the so twice coated fabric was padded (wet pick up at this stage was 25% on weight of goods—O.W.G.). The carpet was then steamed at 210° F. for 8 minutes under atmospheric pressure for color fixation. The total pick up after steaming was 26% O.W.G. The carpet was then dried.

Excellent color penetration down to the roots of the carpet pile was obtained and the printed definitions were good and gave satisfactory color fastness and good antistatic properties.

EXAMPLE 3

A foamable composition was prepared from one part Cellosize QP 52,000 (a commercially available hydroxyethyl cellulose), 95.5 water, 1 part soda ash, 1 part sodium bicarbonate and 1.5 parts Unamide N-72-3 (a coconut alkanol amide from Lonza Chemical Co.)

Six parts of Leavafix Red E2-B (Reactive Red 41) and 94 parts of the above composition were mixed, foamed to a blow ratio of 3:1 and printed on samples of cotton terry cloth fabric using a 50 mesh rotary screen printer.

A portion of the foamable composition for use as the blanket foam was foamed to a 5:1 blow ratio and 10 mils knife coated onto the two terry cloth fabric samples onto which the reactive dye was previously printed. One sample was then padded and the other vacuumed and padded and the samples were wet steamed at 210° F. for 8 minutes for color fixation.

Good color penetration was achieved on the printed cotton pile fabric. Portions of the two samples were rinsed, soaped, rinsed and dried and found to have good reactive dye fixation.

EXAMPLE 4

A foamable printing composition was prepared by mixing 6 parts Esterquinone Red BA 80% (Disperse Red 60) and 94 parts of a composition containing 92.5% water, 3.5% ASE-60, 0.5% ammonia and 3.5% ammonium stearate (33% soln.), foamed to a 3:1 blow ratio and printed on a polyester carpet pile of Kodel V using a 50 mesh rotary screen printer.

A blanket composition of 92.5% water, 3.5% ASE-60, 0.5% ammonia and 3.5% ammonium stearate (33% soln.) was foamed to a 5:1 blow ratio and coated 20 mils thick on the previously printed carpet. The carpet was then vacuumed from the backing side and padded at 10 p.s.i. pad pressure (15% wet pick up). The color was fixed by wet steaming at 210° F. for 15 minutes followed by drying at 300° F. for 2 minutes.

The polyester carpet printed in this manner gave good color penetration inside the pile.

EXAMPLE 5

A 50/50 mixture of two powdered dyes, Toner Indol Red DC-154 (no Color Index) and Eastman Polyester Blue GBT (Color Index Disperse Blue 118), was prepared.

The mixture was randomly sprinkled on a 50/50 polyester/cotton print cloth.

Two samples were prepared. Sample A was coated with a foamed composition consisting of 71 parts water, 15 parts of Valbond-6063 (an acrylic copolymer emulsion), 10 parts of Valrez-248 (a glyoxal resin), 2 parts of Valcat 7 (a magnesium chloride solution) and 2 parts of Valdet CC (a fatty acid diethanolamide).

A 6 mil coating of the foam having a blow ratio of 8:1 was applied via a knife coater. The foam coated fabric was passed through a vertical pad to collapse the foam. The fabric was then dried and cured for 3 minutes at 300° F.

Sample B was padded through a bath consisting of 86.5 parts water, 7.5 parts Valbond-6063, 5 parts Valrez-248 and 1 part Valcat-7. The fabric was dried and cured as sample A.

Sample A displayed discrete spots of red and blue and was a very pleasing effect. During the application of the foam to the fabric it was observed that there was no transfer of color into the rolling bank of foam.

On sample B, however the colors were smeared out and faded with no discrete dots of color. Most of the colorant had bled into the pad bath.

EXAMPLE 6

A print paste was prepared by mixing 4 parts Merpacyl Blue SW (Liquid Acid Blue 25) and 96 parts Polygum 272-R-1 (a modified natural gum manufactured by Polymer Industries—8% solution). The viscosity of print paste was 8,000 cps. (#6 spindle @20 r.p.m.) The print paste was used to print a nylon carpet sample using a 50 mesh rotary screen. Then the wet print on carpet was subjected to the following foam application to obtain penetration.

A composition containing 1.5 parts fatty acid diethanolamide, 0.75 parts QP52,000 (hydroxyethyl cellulose) and 97.75 parts water was prepared. The composition was foamed to 4:1 blow ratio. This foam was used to knife coat a 50 mil blanket on the wet printed carpet and the carpet sample was subjected to vacuuming and padding. The carpet sample was then steamed at 210° F. for 5 minutes and then dried. Good print definition and color penetration was obtained by the blanket foam application as compared with a conventionally printed control.

Although the present invention has been described in detail with reference to specific examples and embodiments, it is considered apparent that many modifications and alterations can be made without departing from the scope and spirit of the invention as defined by the appended claims.

What is claimed is:

1. A method of printing patterns on selected portions of textile materials comprising the steps of:

(a) applying a color-containing printing composition to a selected portion of a textile material in accordance with a pre-selected pattern;

(b) thereafter uniformly coating said textile material to which said printing composition has been applied with a foamed composition to form a blanket over said previously applied printing composition prior to fixation thereof, said blanket of foam being of a sufficient thickness and coated over said color-containing printing composition so as to facilitate substantially uniform penetration of said printing composition into said textile material upon collapsing of said foam composition;

(c) collapsing said foamed composition to result in substantially uniform penetration of said printing composition into said textile material in accordance with said pre-selected pattern; and (d) thereafter fixing the color on said printed textile material.

2. The method according to claim 1 wherein said color-containing printing composition is applied to said textile material by means of a rotary screen printer.

3. The method according to claim 2 wherein said printing composition contains an acid dye and said textile material is a nylon pile fabric.

4. The method according to claim 1 wherein said color-containing printing composition is applied to said textile material by means of an intaglio printing cylinder.

5. The method according to claim 1, wherein said textile material comprises a high pile fabric and said foamed composition contains no color and is applied with a coating knife.

6. The method according to claim 1 wherein said color containing printing composition is applied to said textile material in the form of a foam.

7. The method according to claim 6 wherein the foam density of each of said foam compositions is in the range of from about 0.5 gm/cc to about 0.05 gm/cc.

8. The method according to claim 6 wherein said foaming composition is substantially free of any color containing material and is prepared by foaming a composition comprised of a liquid and a foaming agent, to a blow ratio in the range of from about 2:1 to about 20:1.

9. The method according to claim 1 wherein said printing composition contains a disperse dye and said textile material is a polyester pile fabric or a nylon pile fabric.

10. A method of printing on textile materials comprising the steps of:

(a) applying a color-containing foamed printing composition to a textile material in accordance with a pre-selected pattern, said printing composition having a foam density in the range of from about 0.5 gm/cc to about 0.05 gm/cc and being prepared by foaming a composition comprised of liquid, color material and a foaming agent to a blow ratio in the range of from about 2:1 to about 20:1;

(b) thereafter uniformly coating said textile material to which said printing composition has been applied with a second foamed composition, having a foam density in the range of from about 0.5 gm/cc to about 0.05 gm/cc, to form a blanket over said previously applied foamed printing composition prior to fixation thereof;

(c) collapsing said second applied foamed composition to result in penetration of said printing composition into said textile material in said pre-selected pattern; and (d) thereafter fixing the color on said printed textile material.

* * * * *